US012516679B1

(12) United States Patent
Lai

(10) Patent No.: US 12,516,679 B1
(45) Date of Patent: Jan. 6, 2026

(54) FAN ACCESSORY AND FAN ASSEMBLY

(71) Applicant: Aivres Systems Inc., San Jose, CA (US)

(72) Inventor: Cheng-Hong Lai, New Taipei (TW)

(73) Assignee: Aivres Systems Inc., San Jose, CA (US)

( * ) Notice: Subject to any disclaimer, the term of this patent is extended or adjusted under 35 U.S.C. 154(b) by 0 days.

(21) Appl. No.: 19/060,054

(22) Filed: Feb. 21, 2025

(51) Int. Cl.
*F04D 29/54* (2006.01)

(52) U.S. Cl.
CPC ..... *F04D 29/547* (2013.01)

(58) Field of Classification Search
CPC ..... F04D 29/547
See application file for complete search history.

(56) References Cited

U.S. PATENT DOCUMENTS 10,890,383 B2 * 1/2021 Sun ..... F28C 1/14
11,956,928 B1 * 4/2024 Taylor ..... F24F 7/06

FOREIGN PATENT DOCUMENTS

WO WO-2017202871 A1 * 11/2017 ..... F24F 13/02

* cited by examiner

*Primary Examiner* — Sabbir Hasan
(74) *Attorney, Agent, or Firm* — Sheppard Mullin Richter & Hampton LLP

(57) ABSTRACT

A fan accessory includes an air-inlet piece configured to be disposed in front of a fan and has a first hole adjacent to an outside and a second hole adjacent to the fan. The first hole is in communication with the second hole. The first hole has a first diameter gradually decreased in an airflow direction from the outside to the fan, and the second hole has a second diameter gradually increased in the airflow direction. The fan accessory also includes an air-outlet piece configured to be disposed behind the fan and have a third hole. The third hole has a third diameter gradually decreased in the airflow direction.

18 Claims, 3 Drawing Sheets

FAN ACCESSORY AND FAN ASSEMBLY

TECHNICAL FIELD

This disclosure is generally related to accessories for a cooling fan and fan assemblies.

BACKGROUND

Modern computer servers generate a lot of heat and are in need of efficient cooling strategies to reach best computing performance. The servers may be cooled by air, liquid, or both. Considering the cost and performance, air cooling has been a dominant technique to cool computer servers.

Currently there is only air duct to direct the airflow to a cooling fan, but this configuration would not be able to enhance the ability of air cooling. Air cooling may not make good effect to cool down the System on Chip (SoC) systems that generally associate with higher power consumption. Further, the size of a fan could not be increase due to the size of racks being limited, i.e., the height of each chassis in the rack could not be changed. When a high performance SoC is used, users generally would be suggested to use liquid cooling to obtain much stronger cooling ability to achieve the heat dissipation. But the complexity of system design and cost of liquid cooling are much higher than air cooling.

SUMMARY

Described herein are fan accessories and fan assemblies with improved cooling ability for computer servers.

In one general aspect, a fan accessory may include an air-inlet piece configured to be disposed in front of a fan and have a first hole adjacent to an outside and a second hole adjacent to the fan. The first hole is in communication with the second hole. The first hole has a first diameter gradually decreased in an airflow direction from the outside to the fan, and the second hole has a second diameter gradually increased in the airflow direction. The fan accessory may also include an air-outlet piece configured to be disposed behind the fan and have a third hole. The third hole has a third diameter gradually decreased in the airflow direction. Other embodiments of this aspect include corresponding computer systems that incorporate the fan accessories.

In some embodiments, the air-inlet piece further may include a fourth hole disposed between and in communication with the first hole and the second hole, where a diameter of the fourth hole is a constant.

In some embodiments, the first hole has a largest diameter greater than a largest diameter of the second hole. In some embodiments, the first hole has a smallest diameter equal to a smallest diameter of the second hole and equal to the diameter of the fourth hole. In some embodiments, the first hole has a depth greater than a depth of the second hole, and the depth of the second hole is greater than a depth of the fourth hole.

In some embodiments, the air-outlet piece may further include a fifth hole in communication with the third hole, where a diameter of the fifth hole is a constant. In some embodiments, the third hole has a smallest diameter equal to the diameter of the fifth hole. In some embodiments, the third hole has a depth greater than a depth of the fifth hole. In some embodiments, the first hole has a depth greater than a depth of the second hole. In some embodiments, a surface of the first hole, a surface of the second hole, and a surface of the third hole are flat.

In another general aspect, a fan assembly may include a fan. The fan assembly may also include an air-inlet piece configured to be disposed in front of the fan and having a first hole adjacent to an outside and a second hole adjacent to the fan. The first hole is in communication with the second hole. The first hole has a first diameter gradually decreased in an airflow direction from the outside to the fan, and the second hole has a second diameter gradually increased in the airflow direction. The fan assembly may further include an air-outlet piece configured to be disposed behind the fan and having a third hole. The third hole has a third diameter gradually decreased in the airflow direction. Other embodiments of this aspect include corresponding computer systems that incorporate the fan assembly.

In yet another general aspect, a fan assembly may include a fan. The fan assembly may also include an air-inlet piece configured to be disposed in front of the fan and have a first hole adjacent to an outside and a second hole adjacent to the fan. The first hole is in communication with the second hole. The first hole has a first diameter gradually decreased in an airflow direction from the outside to the fan, and the second hole has a second diameter gradually increased in the airflow direction. The fan assembly may further include an air-outlet piece configured to be disposed behind the fan and having a third hole. The third hole has a third diameter gradually decreased in the airflow direction. The fan assembly may also include a fastener configured to fasten the air-inlet piece and the air-outlet piece to the fan. Other embodiments of this aspect include corresponding computer systems that incorporate the fan assembly.

BRIEF DESCRIPTION OF THE DRAWINGS

Certain features of various embodiments of the present technology are set forth with particularity in the appended claims. A better understanding of the features and advantages of the technology will be obtained by reference to the following detailed description that sets forth illustrative embodiments, in which the principles of the disclosure are utilized, and the accompanying drawings of which:

DETAILED DESCRIPTION OF EMBODIMENTS

Figure 1:
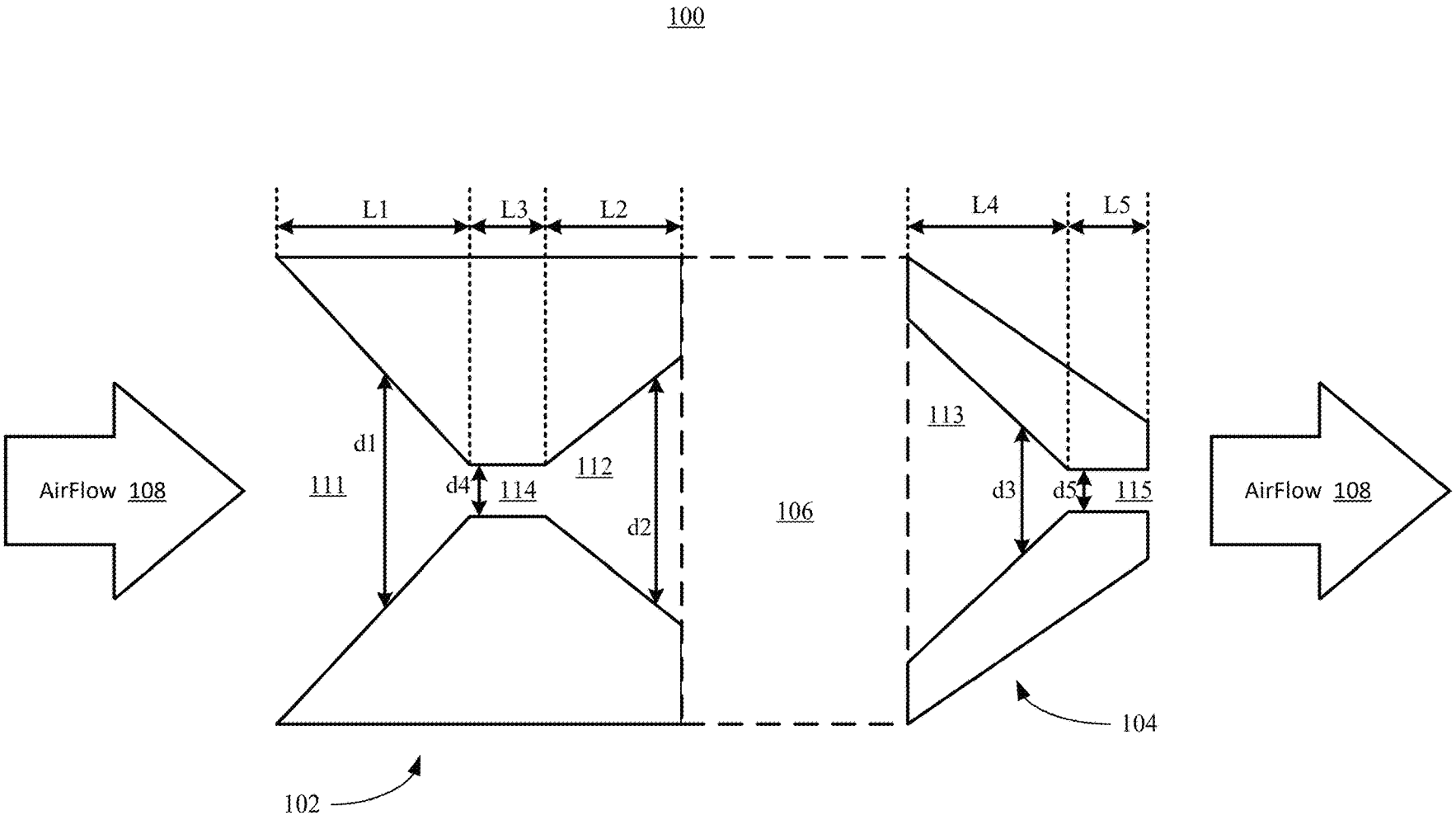
FIG. 1 is a cross-sectional view of a fan accessary according to one example embodiment.

In the following description, certain specific details are set forth in order to provide a thorough understanding of various embodiments of the disclosure. However, one skilled in the art will understand that the disclosure may be practiced without these details. Moreover, while various embodiments of the disclosure are disclosed herein, many adaptations and modifications may be made within the scope of the disclosure in accordance with the common general knowledge of those skilled in this art. Such modifications include the substitution of known equivalents for any aspect of the disclosure in order to achieve the same result in substantially the same way.

Unless the context requires otherwise, throughout the present specification and claims, the word "comprise" and variations thereof, such as, "comprises" and "comprising" are to be construed in an open, inclusive sense, that is as "including, but not limited to." Recitation of numeric ranges of values throughout the specification is intended to serve as a shorthand notation of referring individually to each separate value falling within the range inclusive of the values defining the range, and each separate value is incorporated in the specification as it were individually recited herein. Additionally, the singular forms "a," "an" and "the" include plural referents unless the context clearly dictates otherwise.

Reference throughout this specification to "one embodiment" or "an embodiment" means that a particular feature, structure or characteristic described in connection with the embodiment is included in at least one embodiment of the present disclosure. Thus, the appearances of the phrases "in one embodiment" or "in an embodiment" in various places throughout this specification are not necessarily all referring to the same embodiment, but may be in some instances. Furthermore, the particular features, structures, or characteristics may be combined in any suitable manner in one or more embodiments.

Various embodiments described herein are directed to fan accessories and fan assemblies that are designed to improve their cooling ability. The techniques disclosed herein can be applied to existing fans to increase the fans' cooling performance. In one embodiment, a fan accessory is provided. The fan accessory may include: an air-inlet piece configured to be disposed in front of a fan and may include a first hole adjacent to an outside and a second hole adjacent to the fan, where the first hole is in communication with the second hole, the first hole has a first diameter gradually decreased in an airflow direction from the outside to the fan, and the second hole has a second diameter gradually increased in the airflow direction; and an air-outlet piece configured to be disposed in back of the fan and may include a third hole, where the third hole has a third diameter gradually decreased in the airflow direction.

In another embodiment, a fan assembly is provided. The fan assembly may include: a fan; an air-inlet piece configured to be disposed in front of the fan and may include a first hole adjacent to an outside and a second hole adjacent to the fan, where the first hole is in communication with the second hole, the first hole has a first diameter gradually decreased in an airflow direction from the outside to the fan, and the second hole has a second diameter gradually increased in the airflow direction; and an air-outlet piece configured to be disposed in back of the fan and may include a third hole, where the third hole has a third diameter gradually decreased in the airflow direction.

In another embodiment, a fan assembly is provided. The fan assembly may include a fan; an air-inlet piece configured to be disposed in front of the fan and may include a first hole adjacent to an outside and a second hole adjacent to the fan, where the first hole is in communication with the second hole, the first hole has a first diameter gradually decreased in an airflow direction from the outside to the fan, and the second hole has a second diameter gradually increased in the airflow direction; an air-outlet piece configured to be disposed in back of the fan and may include a third hole, where the third hole has a third diameter gradually decreased in the airflow direction; and a fastener configured to fasten the air-inlet piece and the air-outlet piece to the fan.

Further embodiments will now be explained with the accompanying figures. Reference is first made to FIG. 1. FIG. 1 is a cross-sectional view of a fan accessary 100 according to one example embodiment. The fan accessary 100 includes an air-inlet piece 102 and an air-outlet piece 104. The air-inlet piece 102 is configured to be disposed in front of a fan 106 with respect to the airflow direction 108, and the air-outlet piece 104 is configured to be disposed behind the fan 106.

The air-inlet piece 102 includes a first hole 111 adjacent to an outside to receive the airflow 108. The air-inlet piece 102 has a first diameter d1 gradually decreased in the airflow direction from the outside to the fan 106. The air-inlet piece 102 further includes a second hole 112 adjacent to the fan 106. The second hole 112 has a second diameter d2 gradually increased in the airflow direction.

The air-outlet piece 104 includes a third hole 113. The third hole 113 has a third diameter d3 gradually decreased in the airflow direction.

By the above configurations, the disclosed fan accessory 100 can improve air cooling ability. When the air go through the first hole 111 and the second hole 112 of the air-inlet piece 102, it is compressed and then expanded. The expansion causes the air to lose energy and undergo cooling, resulting in the air at the output of the air-inlet piece 102 to be cooler than it is at the input. The cooler air input to the fan allows the cooling system to be more effective in cooling the systems that generate heat.

Referring again to FIG. 1, in some embodiments, the air-inlet piece 102 further includes a fourth hole 114 disposed between and in communication with the first hole 111 and the second hole 112. In some embodiments, the diameter d4 of the fourth hole 114 is a constant. In some embodiments, the first hole 111 has a largest diameter (e.g., at the edge adjacent to the outside) greater than a largest diameter (e.g., at the edge adjacent to the fan 106) of the second hole 112. The first hole 111 has a smallest diameter (e.g., at the edge adjacent to the fourth hole 114) equal to a smallest diameter (e.g., at the edge adjacent to the fourth hole 114) of the second hole 112 and also equal to the diameter d4 of the fourth hole. In some embodiments, the first hole 111 has a depth L1 greater than a depth L2 of the second hole 112. In some embodiments, the depth L2 of the second hole 112 is greater than a depth L3 of the fourth hole 114. This configuration allows the maximum air inflow and at the same time cools the inflow air at the air-inlet piece 102. In other implementations, the diameter d4 of the fourth hole 114 may not be a constant as long as the fourth hole 114 enables the communication of the first hole 111 and the second hole 112.

In some embodiments, the air-outlet piece 104 further includes a fifth hole 115 in communication with the third hole 113, where a diameter d5 of the fifth hole 115 is a constant. In some embodiments, the third hole 113 has a smallest diameter (e.g., at the edge adjacent to the fifth hole 115) equal to the diameter d5 of the fifth hole 115. In some embodiments, the third hole 113 has a depth L4 greater than a depth L5 of the fifth hole 115. After the air is moved through the fan 106, it is again compressed at the third hole 113 and the fifth hole 115 and output from the fifth hole 115 to a target machine (e.g., SoC systems, not shown) to cool the target machine. The compressed air output from the fifth hole 115 is allowed to expand. The expansion causes the air to lose energy and undergo cooling, resulting in the air at the output of the air-outlet piece 104 to be cooler than it is at the input. The cooler air allows the cooling system to be more effective in cooling the target (e.g., SoC) systems.

In some embodiments, to facilitate the airflow from the air-inlet piece 102 to the air-outlet piece 104, the surfaces of the first hole, the second hole, and the third hole are configured to be flat to reduce the drag on the air. Other smoothing surfaces may be employed as long as they reduce the drag on the airflow in the system.

Figure 2:
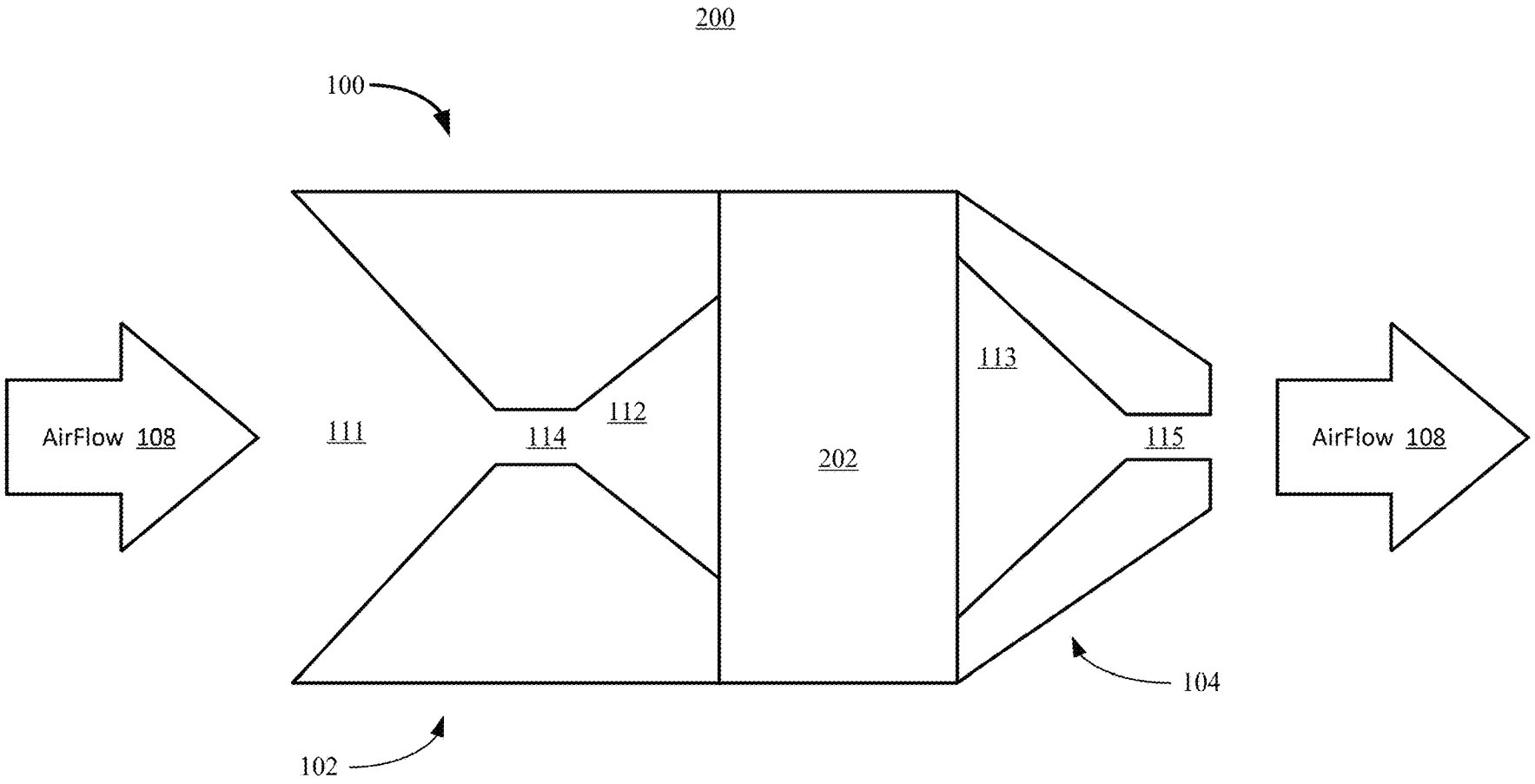
FIG. 2 is a cross-sectional view of a fan assembly according to one example embodiment.

Reference is now made to FIG. 2. FIG. 2 is a cross-sectional view of a fan assembly 200 according to one example embodiment. The fan assembly 200 includes the fan accessory 100 of FIG. 1 and a fan 202. As explained above, the fan accessory 100 can reduce the air temperature for cooling purpose, which enables the fan assembly 200 to be suitable as an air cooling system for a computer, servers, server racks, and/or server towers.

Figure 3:
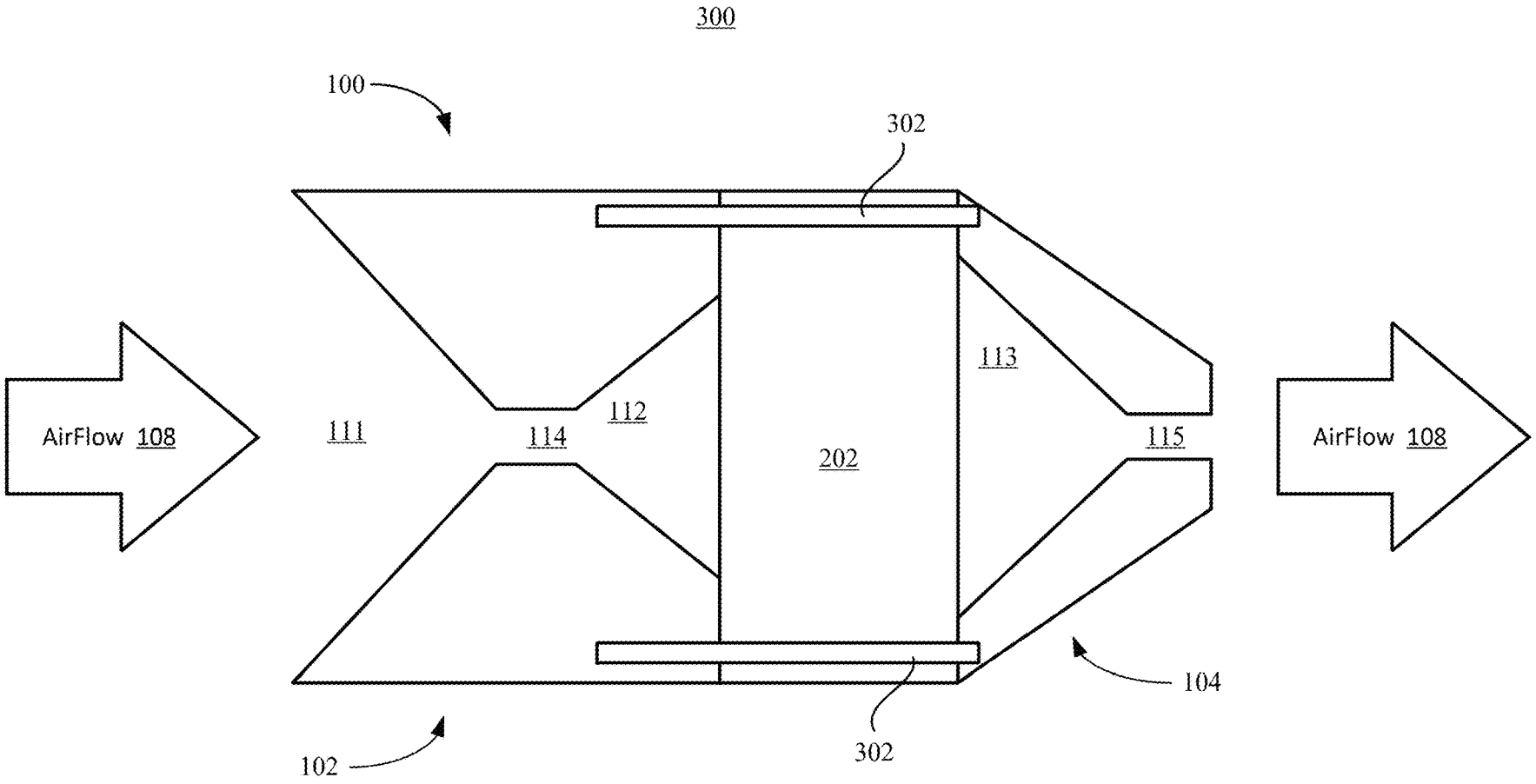
FIG. 3 is a cross-sectional view of another fan assembly according to one example embodiment.

FIG. 3 is a cross-sectional view of a fan assembly 300 according to one example embodiment. The fan assembly 300 includes the fan assembly 200 of FIG. 2 and a fastener 302 configured to fasten the air-inlet piece 102 and the air-outlet piece 104 to the fan 202. In some embodiments, the fastener 302 may be a buckle, a screw, a latch, or other connectors that can fasten the fan accessory 100 to the fan 202.

The disclosed fan accessory can be latched at the inlet and outlet of the fan. In some implementations, the air-inlet piece may be of a conical shell. For example, the narrow side of the conical shell may be directed toward the inlet of the fan. The conical shell can compress the air such that the air passing through the shell would be cooled down once. In addition, the narrow side of the air-outlet piece is directed toward the outlet side. The air blown from the fan can be compressed again by passing through the air-outlet piece, and the air can be cooled down again, so the airflow could take away more heat.

In some embodiments, the disclosed fan accessory may be made by a metal material such as copper, aluminum, iron, etc. In one embodiment, the disclosed fan accessory is made by aluminum because of its cost-performance ratio. In general, aluminum has a better thermal conductivity than iron, and cheaper than copper. In some embodiments, the fan accessary including the air-inlet piece and the air-outlet piece may be hollow structures to reduce cost. In some embodiments the surfaces of the holes in the air-inlet piece and the air-outlet piece may be coated with an insulating material such as plastics or polymers to reduce heat exchange with the airflow.

In some embodiments, the disclosed fan accessory may fit with the existing fans such that there is no need to change design of any fan sold on the market, And the same time, the disclosed fan accessory improves the cooling ability of the existing fans. The size of the fan accessory including the air-inlet piece and the air-outlet piece can be designed to accommodate the legacy fans.

The foregoing description of the present disclosure has been provided for the purposes of illustration and description. It is not intended to be exhaustive or to limit the disclosure to the precise forms disclosed. The breadth and scope of the present disclosure should not be limited by any of the above-described exemplary embodiments. Many modifications and variations will be apparent to the practitioner skilled in the art. The modifications and variations include any relevant combination of the disclosed features. The embodiments were chosen and described in order to best explain the principles of the disclosure and its practical application, thereby enabling others skilled in the art to understand the disclosure for various embodiments and with various modifications that are suited to the particular use contemplated. It is intended that the scope of the disclosure be defined by the following claims and their equivalence.

What is claimed is:

1. A fan accessory comprising:

an air-inlet piece configured to be disposed in front of a fan and comprising a first hole adjacent to an outside and a second hole adjacent to the fan, wherein the first hole is in communication with the second hole, the first hole has a first diameter gradually decreased in an airflow direction from the outside to the fan, and the second hole has a second diameter gradually increased in the airflow direction; and an air-outlet piece configured to be disposed behind the fan and comprising a third hole, wherein the third hole has a third diameter gradually decreased in the airflow direction, wherein the air-inlet piece further comprises a fourth hole disposed between and in communication with the first hole and the second hole, wherein a diameter of the fourth hole is a constant.

2. The fan accessory of claim 1, wherein the first hole has a largest diameter greater than a largest diameter of the second hole.

3. The fan accessory of claim 2, wherein the first hole has a smallest diameter equal to a smallest diameter of the second hole and equal to the diameter of the fourth hole.

4. The fan accessory of claim 1, wherein the air-outlet piece further comprises a fifth hole in communication with the third hole, wherein a diameter of the fifth hole is a constant.

5. The fan accessory of claim 4, wherein the third hole has a smallest diameter equal to the diameter of the fifth hole.

6. The fan accessory of claim 1, wherein the first hole has a depth greater than a depth of the second hole.

7. The fan accessory of claim 1, wherein the first hole has a depth greater than a depth of the second hole, and the depth of the second hole is greater than a depth of the fourth hole.

8. The fan accessory of claim 4, wherein the third hole has a depth greater than a depth of the fifth hole.

9. The fan accessory of claim 1, wherein a surface of the first hole, a surface of the second hole, and a surface of the third hold are flat.

10. A fan assembly comprising:

a fan;

an air-inlet piece configured to be disposed in front of the fan and comprising a first hole adjacent to an outside and a second hole adjacent to the fan, wherein the first hole is in communication with the second hole, the first hole has a first diameter gradually decreased in an airflow direction from the outside to the fan, and the second hole has a second diameter gradually increased in the airflow direction; and an air-outlet piece configured to be disposed behind the fan and comprising a third hole, wherein the third hole has a third diameter gradually decreased in the airflow direction, wherein the air-outlet piece further comprises a fifth hole in communication with the third hole, wherein a diameter of the fifth hole is a constant.

11. The fan assembly of claim 10, wherein the air-inlet piece further comprises a fourth hole disposed between and in communication with the first hole and the second hole, wherein a diameter of the fourth hole is a constant.

12. The fan assembly of claim 11, wherein the first hole has a largest diameter greater than a largest diameter of the second hole.

13. The fan assembly of claim 12, wherein the first hole has a smallest diameter equal to a smallest diameter of the second hole and equal to the diameter of the fourth hole.

14. The fan assembly of claim 10, wherein the third hole has a smallest diameter equal to the diameter of the fifth hole.

15. The fan assembly of claim 10, wherein the first hole has a depth greater than a depth of the second hole.

16. The fan assembly of claim 11, wherein the first hole has a depth greater than a depth of the second hole, and the depth of the second hole is greater than a depth of the fourth hole.

17. The fan assembly of claim 10, wherein the third hole has a depth greater than a depth of the fifth hole.

18. A fan assembly comprising a fan;

an air-inlet piece configured to be disposed in front of the fan and comprising a first hole adjacent to an outside and a second hole adjacent to the fan, wherein the first hole is in communication with the second hole, the first hole has a first diameter gradually decreased in an airflow direction from the outside to the fan, and the second hole has a second diameter gradually increased in the airflow direction;

an air-outlet piece configured to be disposed behind the fan and comprising a third hole, wherein the third hole has a third diameter gradually decreased in the airflow direction; and a fastener configured to fasten the air-inlet piece and the air-outlet piece to the fan, wherein the first hole has a depth greater than a depth of the second hole.

* * * * *